US006149764A

United States Patent [19]

Steiner et al.

[11] Patent Number: 6,149,764

[45] Date of Patent: Nov. 21, 2000

[54] DEVICE FOR SECURING TOOLS INTENDED FOR TRANSFERRING METALLIC FILMS ONTO A SUBSTRATE AND PROCESS FOR PRODUCING A TEMPLATE FOR THE POSITIONING OF THESE TOOLS

[75] Inventors: Jean-Pierre Steiner, Crisser; Pierre Bignens, Prilly, both of Switzerland

[73] Assignee: Bobst S.A., Lausanne, Switzerland

[21] Appl. No.: 09/095,335

[22] Filed: Jun. 10, 1998

[30] Foreign Application Priority Data

Jun. 13, 1997 [CH] Switzerland ..... 1441/97

[51] Int. Cl.[7] ..... B44C 31/00; B44C 1/165; B30B 37/00; B30B 5/02; B41C 1/06

[52] U.S. Cl. ..... 156/540; 156/580; 156/583.1; 156/230; 156/233; 101/9; 101/34

[58] Field of Search ..... 156/230, 233, 156/240, 238, 540, 543, 580, 583.1; 101/9, 34, 408

[56] References Cited

U.S. PATENT DOCUMENTS

| | | | |
|---|---|---|---|
| 2,230,870 | 2/1941 | Noell . | |
| 3,753,850 | 8/1973 | Brunet | 156/233 |
| 5,098,508 | 3/1992 | Mattil | 156/363 |
| 5,264,069 | 11/1993 | Dietrich et al. | 156/559 |

FOREIGN PATENT DOCUMENTS

| | | |
|---|---|---|
| 5004943 | 3/1920 | France . |
| 447154 | 5/1936 | United Kingdom . |
| 813550 | 5/1959 | United Kingdom . |

*Primary Examiner*—James Sells
*Assistant Examiner*—Jerry A. Lorengo
*Attorney, Agent, or Firm*—Allen N. Friedman; McCarter & English, LLP

[57] ABSTRACT

The disclosed positioning and securing device for plate-shaped tools (3) for the hot pressure transfer of portions of metallic film webs onto a substrate, comprises a supporting and heating plate (1) for the tools (3), covered by a plurality of apertures (2) adapted to receive securement means for the tools (3). This device includes positioning means for the tools (3) comprising, on the one hand, a template (9) covering the supporting and heating plate (1), provided with first distinctive marks for position each of the tools (3) on said plate (1). The latter itself includes removable positioning and securement means for the template (9). On the other hand, the positioning means includes second markers (12), provided on the upper surface of each of the tools (3), the positions of which correspond to the positions of the respective first marks of said template (9). A method for producing said template (9) is also disclosed.

9 Claims, 3 Drawing Sheets

DEVICE FOR SECURING TOOLS INTENDED FOR TRANSFERRING METALLIC FILMS ONTO A SUBSTRATE AND PROCESS FOR PRODUCING A TEMPLATE FOR THE POSITIONING OF THESE TOOLS

RELATED APPLICATIONS this application claims priority from Swiss patent application Switzerland No.1997 1441/97

GOVERNMENT FUNDED RESEARCH

Not Applicable

BACKGROUND OF THE INVENTION

1. Field of Invention

The present invention is related to a positioning and securing device for plate-shaped tools intended for the hot-pressure transfer of portions of a metallic film web onto a paper or cardboard substrate.

This device comprises a supporting and heating plate for these tools, covered by a plurality of apertures distributed according to a determined periodicity and adapted to receive securement means for these tools. It is also related to a process for producing a template for positioning these tools on the supporting and heating plate.

2. Brief Description of the Background Art

Relatively thick plates, in which are bored a plurality of evenly distributed apertures and adapted to receive a certain number of tools corresponding to a kind of printing plate positioned and secured to supporting plate, are already in use. Such a plate, thus provided with printing plates, is mounted in a machine fed with blanks of cardboard or paper on the one hand and with a metallic film web on the other hand, for the hot transfer of metallic film portions onto the blanks of cardboard by means of the tools positioned on the supporting plate. Such machines are, for example, used for printing onto packagings. Usually, this printing by means of metallic films follows embossing of the cardboard blanks, so that it is important that the printing plates are positioned accurately so that the printing of the metallic film registers exactly with the imprints made by embossing.

Taking into account the cost of such a supporting and heating plate, it would be too expensive to use to print only one packaging pattern. Furthermore, due to its weight it is not easy to manipulate, which would not facilitate is repositioning. Consequently, one supporting and heating plate is generally used for each machine. When changing the work, it is, thus, necessary to remove the printing plates from the supporting plate and to position other printing plates corresponding to the next job. Since the printing plates are mounted in the cold state but they operate in the hot state, because metals expand when heated, it is not possible to take reference measurements from a preceding printed blank, since the preceding printing resulted from the spacing between hot printing plates. Thus, the positioning operation is exceedingly long and, typically corresponds to a working day. The cost of this operation obviously impacts more heavily on the cost of the printed workpieces in the case of relatively small printing lots.

SUMMARY OF THE INVENTION

The aim of the present invention is to meet, at least partly, the above-mentioned difficulties. For this purpose,. an object of this invention is to produce a positioning and securing device of the aforesaid type for plate shaped tools for the hot-pressure transfer of portions of a metallic film web onto a paper or cardboard substrate, including positioning means for said tools. The positioning means comprises, on the one hand, a template covering the supporting and heating plate, provided with the first distinctive reference markers for positioning of each of the tools on the supporting and heating plate, the plate itself having removable positioning and clamping means for this template. The device also comprises second reference markers of complementary shape to the first markers, provided on the upper surface of each of the tools, the positions of the second markers corresponding to the positions of the respective first markers on the template.

Preferably, the tool securing means comprises on the one hand supporting members designed so that the act of securing them to the supporting plate does not effect their position and, consequently, the position of the tool against the edge of which the supporting member rests. The tool securing means comprises on the other hand, clamping members situated at the portions of the edge of the tool opposite to the portions of the edge in contact with the supporting members.

Preferably, the second markers associated with the tools, include conical elements projecting from the surface of the tools and removably mounted in positioning seats on the upper surface of the tools.

Another object of this invention is a process for producing a template for the positioning of plate-shaped tools for hot-pressure transfer of portions of a metallic film web onto a paper or cardboard substrate, using a set of tools positioned on the supporting and heating plate. The second markers are placed in each of the positioning seats on the tools. The template, consisting of a sheet of plastic, is positioned on the supporting and heating plate. An imprint of each of the second markers is produced in the sheet of plastic, and an aperture is provided at the position of each of the supporting members and clamping members of each of the tools on the supporting and heating plate.

With the device and the process of the invention, once the positioning of the printing plates is achieved, and after letting the supporting and printing plate cool down, the template is made before removing the printing plates. The template is then stored for use when the same job is to be run again. The stored template allows the accurate and rapid replacement of the printing plates at any time, as will be explained in the following description.

Other particularities and advantages of the present invention will become evident from the following description and from the enclosed drawing which illustrate, schematically and by way of example, an embodiment of the device as well as a working mode of the process that is an object of the present invention.

DETAILED DESCRIPTION OF THE INVENTION

Figure 1:
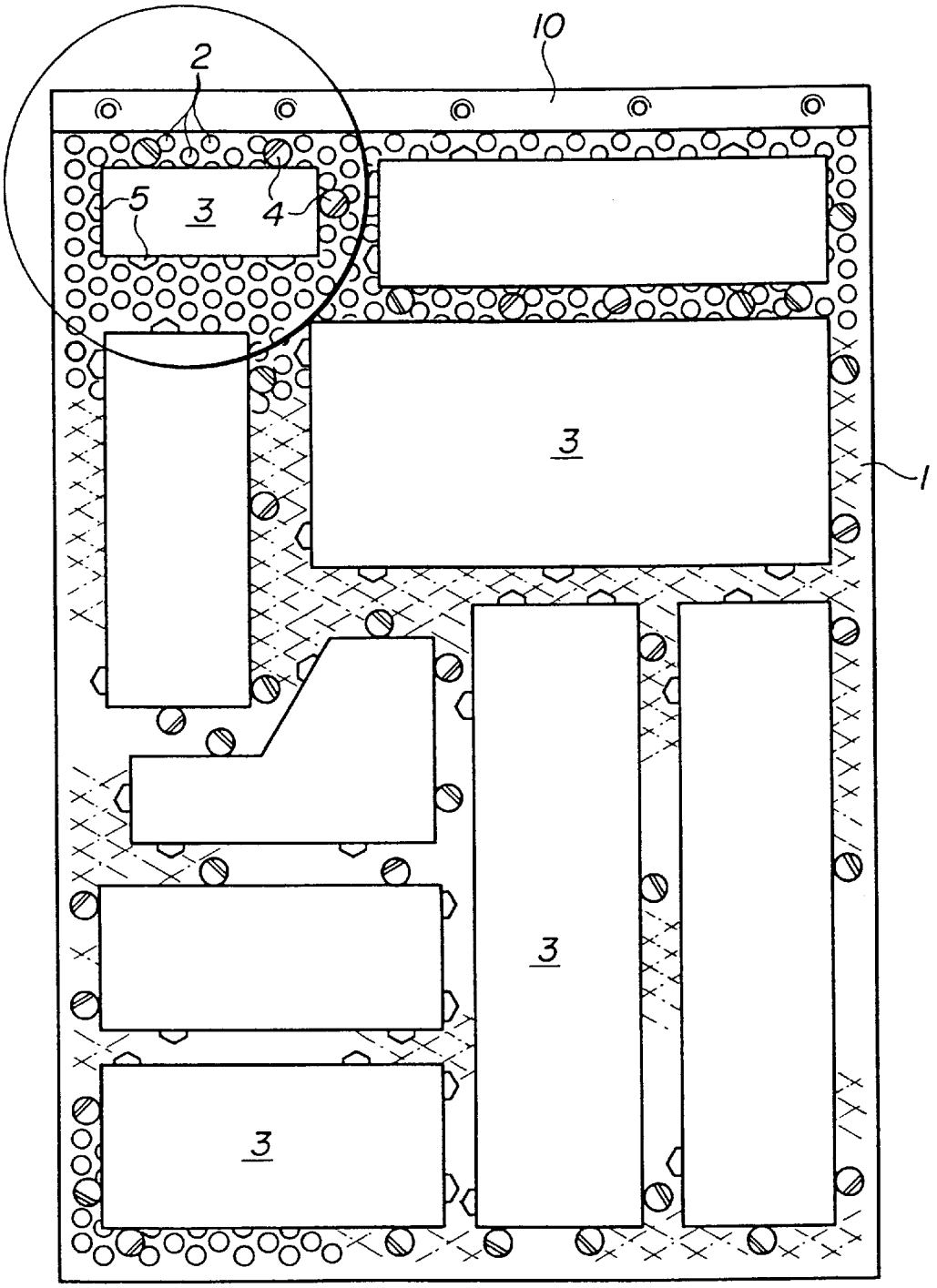
FIG. 1 is a plan view representing an exemplary embodiment of the invention.

The device of the invention includes a supporting and heating plate 1 covered by a plurality of apertures 2 uniformly distributed over the whole supporting and heating plate 1. It can be observed that these apertures 2 are aligned along two axes intersecting at 60° and 120° angles respectively.

A plurality of tools 3, consisting of printing plates for the transfer of metallic films, in the form of small plates of different shapes and dimensions is positioned and secured on to the surface of the supporting and heating plate 1 according to the printing to be performed. The printing plates 3, thus positioned on the supporting and heating plate 1, are adapted to be loaded on a hot-printing press. Since this machine is not a part of the present invention and since it is not necessary to its understanding, the hot-printing press will not be described here.

The process for positioning and securing the tools on the printing plates 3 will be explained now, by means of FIGS. 2 to 4. As can be seen on FIGS. 2 and 3, each printing plate 3 is secured to the supporting plate 1 by two types of securement members. On the one hand, supporting members 4 are placed on two sides of the rectangular printing plate 3 and adjacent to it. On the other hand, clamping members 5 are placed at the opposite sides of the rectangular printing plate 3.

Figure 3:
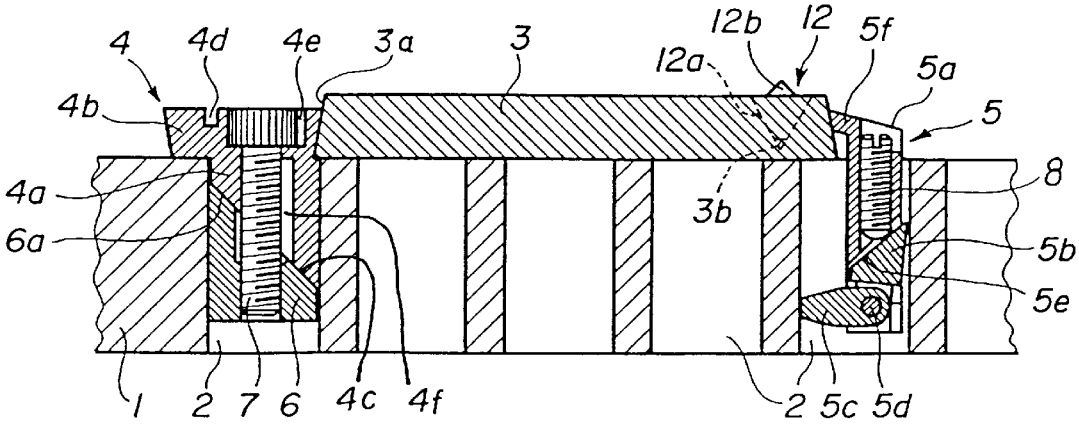
FIG. 3 is a sectional view of FIG. 2; according to line III—III.

As can be seen on FIG. 3, each supporting member 4 comprises a cylindrical part 4*a* pivotally mounted in an aperture 2 of the supporting plate 1 surmounted by an eccentric part 4*b*. The end of the cylindrical part 4*a* located inside the aperture 2 ends in an oblique surface 4*c*. The upper surface of the eccentric 4*b* comprises a slot 4*d* and a seat 4*e*, the bottom of which leads into an axial passage 4*f*. A blocking member 6, consisting of a cylinder with an axial threaded hole. The surface 6*a* of the cylinder adjacent to the cylindrical part 4*a* of the supporting member 4 is oblique and parallel to the surface 4*c* of supporting member 4. The threaded hole engages a tightening screw 7.

By means of this arrangement, the tightening of the screw 7 causes the sliding of the oblique surfaces 4*c*, 6*a* against one another and the wedging of the members 4 and 6 against the walls of the aperture 2. It has to be noted that this tightening mode does not produce any torque on the supporting member 4, thus does not change the angular position of the eccentric 4*b*. This is particularly important. Effectively, as soon as the printing plate is in the required position, the eccentric part 4*b* of the supporting member 4 is turned by means of a screwdriver engaging the slot 4*d* until it comes to rest against the chamfered edge 3 a of the printing plate 3. It should be noted that the edge of the eccentric part 4*b* is formed with a same slant as the chamfer 3*a*.

The clamping members 5, which are arranged on the sides of the printing plates 3 opposite to the sides along which the supporting organs 4*a* are placed, include three elements 5*a*, 5*b*, 5*c*, articulated around a common axis 5*d*. A threaded hole containing a tightening screw 8 extends down through the center of element 5*a*. The element 5*b* has a slanted surface 5*e* located at the end of the threaded hole through which the end of the tightening screw 8 can extend. A claw 5*f* projects laterally from the upper end of the element 5*a* in the direction of the chamfered edge 3*a* of the printing plate 3. The element 5*c* rests against a portion of the wall of aperture 2. The screw 8 forces on the one hand, the element 5*b* against the opposite portion of the wall of this same aperture 2 and on the other hand, forces the claw 5*f* against the chamfered edge 3*a* of the printing plate 3. Since the opposite edge of this printing plate 3 rests against at least one eccentric 4*b*, the printing plate is secured in the exact position defined by the eccentric 4*b*.

The chamfer 3 a also assures that the printing plate is pressed against the surface of the supporting and heating plate 1, which fact is important in order to ensure good thermal transfer between the plate 1 and printing plates 3.

All of the printing plates are mounted in the same manner so that the same operations as those described above recur for each printing plate. Obviously, the number and the arrangement of the supporting members 4 and of the clamping members 5 as well as their distribution are dependent upon the size and the shape of the printing plates 3.

Figure 4:
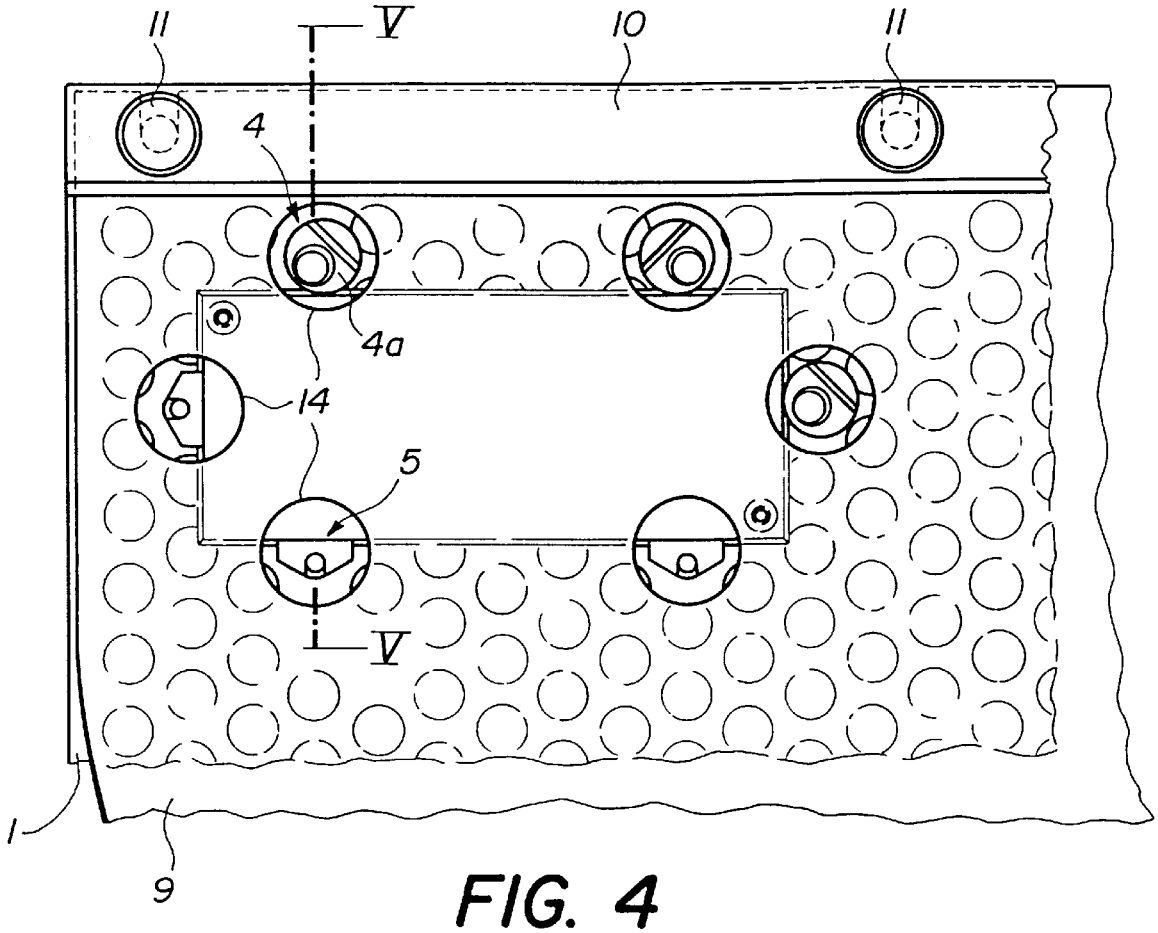
FIG. 4 is a view similar to FIG. 2 showing a template for working the process.
Figure 5:
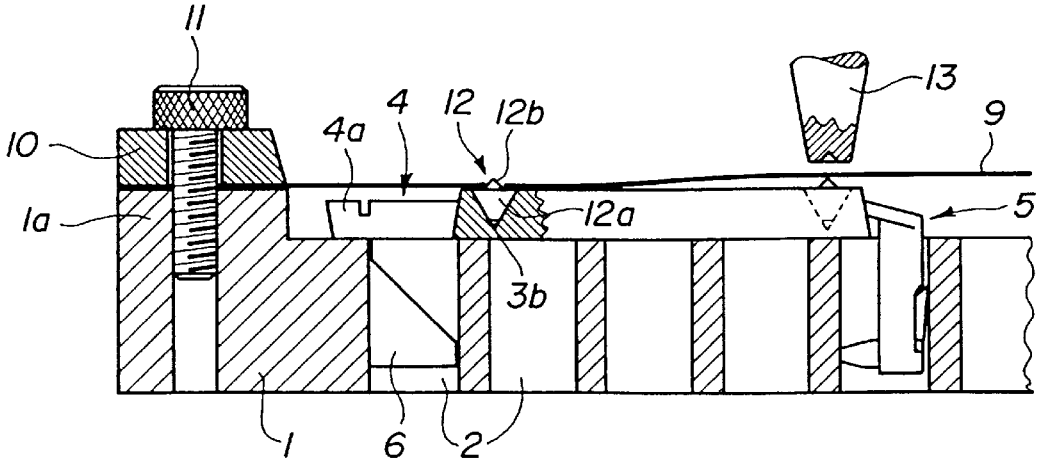
FIG. 5 is a sectional view according to line V—V of FIG. 4.

With reference to FIGS. 4 and 5 it is possible to explain the process for producing a template from a supporting and heating plate 1 provided with a set of printing plates 3 positioned for the purpose of printing according to a determined pattern.

As illustrated by FIGS. 4 and 5, one of the edges of the plate 1 has a positioning shoulder 1*a* for a template 9 in the form of a transparent plastic sheet, for example a sheet of plastic such as Mylar, which is positioned and gripped between this shoulder 1*a* and a clamping bar 10 secured by means of screws 11 distributed along the clamping bar 10.

Figure 2:
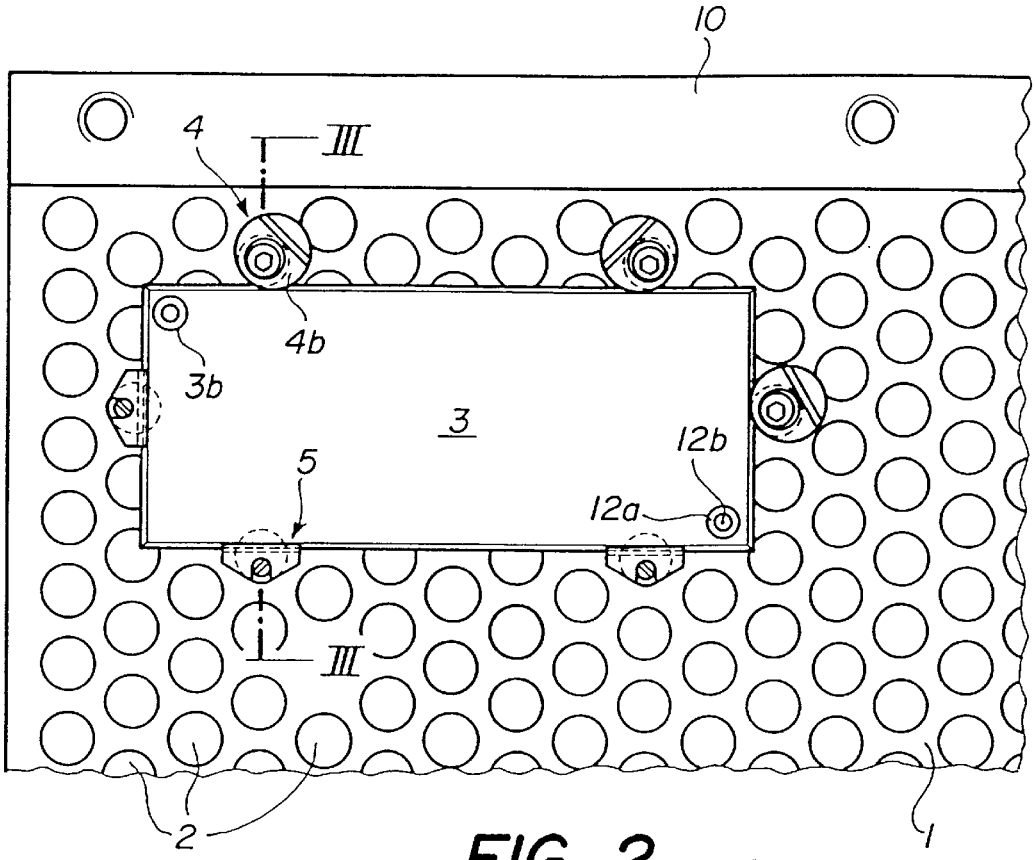
FIG. 2 is an enlarged view of a portion of FIG. 1.

As can be seen on FIGS. 2 to 4, each printing plate 3 is provided with two conical seats 3*b* forming registration and positioning reference elements for the printing plate 3. Reference markers 12 formed of two conical parts 12*a*, 12*b* are placed flush in each of the conical seats 3*b*. As can be seen, the conical part 12*a* is flush with the upper surface of the seat 3*b*, whereas the conical part 12*b*, reversed with respect to the conical part 12*a*, forms a tip projecting above the upper surface of the printing plate 3. These reference markers 12 are, preferably, made of a magnetic material so as to be easily removable from the printing plates once the operation of producing the template 9, which will be described below, is achieved or after having completed the repositioning of the printing plates 3.

In order to produce the template 9, after having positioned it on the supporting and heating plate 1, as described above, imprints of the cones 12*b* of the reference markers 12 are produced by means of a hand punch 13 and a hammer (not represented). Thus, the position of each printing plate is marked on the template 9 by two holes pierced in the template 9.

After this operation, the machine operator again manually approximately marks by means of a felt-tipped pen, for example, the position of every supporting member 4 and clamping member 5, by drawing a circle at the position of these members 4, 5. He then removes the template sheet 9 from the supporting and heating plate and produces apertures 14 with a hollow punch at the position of each circle previously drawn opposite each supporting member 4 and clamping member 5. These apertures 14 subsequently allow the machine operater to access these members 4, 5 and tighten them without needing to lift the template 9 each time, as will be explained below.

Once the template 9 is produced as described above, the printing plates 3 can be removed in order to position another set of printing plates using a different template 9 previously produced in the same manner.

In order to execute this placement operation, the appropriate set of printing plates 3 is selected and they are positioned on the supporting and heating plate 1. The supporting members 4 and the clamping members 5 are placed in the apertures 2 of the plate 1 in the desired number but so that the supporting members 4 are approximately facing the clamping members 5. A reference marker 12 is placed into each conical seat 3*b* of the printing plates 3.

Then, the template sheet 9 corresponding to the positions of the respective printing plates of this set of printing plates is positioned and it is secured by clamping it between the clamping bar 10 and the shoulder la. The positioning of each printing plate 3 is carried out by shifting the plates 3 so as to introduce the cones 12*b* into the holes previously pierced in the template 9. Once this positioning is achieved, the machine operator presses upon the printing plate 3 with one hand and by means of a screwdriver held in the other hand and introduced through the aperture in the template 9 into the slot 4*d*, turns the eccentric 4*b* such that it comes to rest against the edge 3*a* of the printing plate 3. It then remains for him to secure this angular position of the eccentric 4*b* by tightening the screw 7. Now, as has been described above, since this tightening is achieved without producing a torque on the eccentric 4*b*, there is no risk of changing the angular position of the eccentric 4*b* in the course of this operation. Thus, the position of the printing plate 3 remains unchanged. When each eccentric 4*b* of a given printing plate 3 has been placed as described above, the position of this printing plate 3 is determined.

Then, one needs only to tighten the screws 8 of the clamping members to secure them in their respective apertures 2 and to press the claws 5*f* against the respective edges 3*a* of the printing plates 3. The reference markers 12 are then removed by means of a magnet and the template 9 is removed. The supporting and heating plate 1 is then ready for use.

The different templates 9 may be classified according to a classification system adapted to each user. Preferably, in order to facilitate the approximate placement of the printing plates 3, the latter are numbered and their numbers recorded on the template's sheet of plastic, such as Mylar.

We claim:

1. A positioning and securing device for plate-shaped tools (3) for the hot-pressure transfer of portions of metallic film webs onto a paper or cardboard substrate, employing a supporting and heating plate (1) for the tools (3), covered by a plurality of apertures (2) distributed according to a determined periodicity and adapted to receive securement means for the tools (3), the device comprising:

a) positioning means for the tools (3) comprising, on the one hand, a template (9) covering the supporting and heating plate (1), provided with first distinctive marks of the position of each of the tools (3) on the supporting and heating plate (1);

b) removable positioning and clamping means (1*a*, 10, 11) for the template (9); and c) second markers (12*b*) of complementary shape to the first marks, provided on the upper surface of each of tools (3), the positions of which second markers correspond to the positions of the respective first marks of the template (9).

2. A device of claim 1, in which the template (9) also includes apertures (14) adapted to give access to tool securement means (4, 5) on the supporting and heating plate (1).

3. A device of claim 2 in which the tool securement means (4, 5) comprises:

a) supporting members (4) each of which having a cylindrical part (4*a*) pivotally mounted in one of the respective apertures (2) passing through the supporting and heating plate (1) and fixedly attached to an eccentric part (4*b*) extending above the plate (1) and adapted to come to rest against a portion of the edge (3*a*) of one of the tools (3) by rotation of the supporting tool (4), and blocking means (6) of said cylindrical part (4*a*) within said aperture (2), and b) clamping members (5) placed in apertures (2) of said supporting and heating plate (1) located along an edge (3*a*) of said tool (3) facing said respective supporting members and arrange so as to apply pressure against the respective opposite edge (3*a*) of the tool (3) in the direction of the respective supporting members (4), in order to lock said tool (3) in the position defined by the supporting member (4).

4. A device of claim 3 in which the edge (3*a*) of the tool (3) is chamfered, forming an obtuse angle with the upper surface of the supporting and heating plate (1), whereas the edge of the eccentric part (4*a*) of said supporting member (4) has a chamfer complementary to that of the edge (3*a*) of the tool (3).

5. A device of claim 3 in which the cylindrical part (4*a*) of the supporting member (4) includes an axial passage (4*f*) engaging a screw (7) whose head comes to rest on the bottom of a seat (4*e*) provided in the eccentric part (4*a*) and leading into the axial passage (4*f*), this screw (7) being engaged by a threaded hole provided in an independent blocking element (6) located at the free end of the cylindrical part (4*a*), this free end and the surface of the independent blocking element (6) adjacent to this free end having complementary slopes, with respect to the rotation axis of the cylindrical part (4*a*).

6. A device of claim 1 in which the template (9) consist of a sheet of transparent plastic material.

7. A device of claim 1 in which the second markers (12) include conical elements (12*b*) projecting from the upper surface of each of the tools (3) and fixed to respective conical elements (12*a*) removably placed in registration seats (3*b*) provided in the surface of each of the tools (3).

8. Device of claim 7, in which the second markers (12) are made of a material attractable by a magnet.

9. Process for producing a template (9) for the positioning of plate-shaped tools (3) for the hot-pressure transfer of portions of a metallic film web onto a paper or cardboard substrate, from a set of said tools (3) positioned on supporting and heating plate (1), by means of a device of claim 1, comprising:

a) placing the second markers (12) in registration seats (3*b*) of the tools (3);

b) positioning a sheet of plastic adapted to form the template (9) on the supporting and heating plate (1);

c) forming an imprint of each of the second markers (12) in the sheet of plastic;

d) forming an aperture (12) facing each of the securement means, (4, 5) of the tools (3) on the supporting and heating plate (1).

* * * * *